US009728897B2

(12) United States Patent
Belisle

(10) Patent No.: US 9,728,897 B2
(45) Date of Patent: Aug. 8, 2017

(54) POWER CONNECTOR ASSEMBLIES

(71) Applicant: Hamilton Sundstrand Corporation, Charlotte, NC (US)

(72) Inventor: Francis C. Belisle, Roscoe, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 28 days.

(21) Appl. No.: 14/862,936

(22) Filed: Sep. 23, 2015

(65) Prior Publication Data

US 2017/0085033 A1 Mar. 23, 2017

(51) Int. Cl.
*H01R 25/00* (2006.01)
*H01R 13/642* (2006.01)
*H01R 27/02* (2006.01)

(52) U.S. Cl.
CPC ..... *H01R 13/642* (2013.01); *H01R 25/00* (2013.01); *H01R 27/02* (2013.01)

(58) Field of Classification Search
CPC ..... H01R 13/642
USPC ..... 439/638, 639, 680, 540.1
See application file for complete search history.

(56) References Cited

U.S. PATENT DOCUMENTS 5,342,221 A * 8/1994 Peterson ..... H01R 13/64 439/677
6,352,447 B1 * 3/2002 Ruth ..... H01R 13/518 439/501
6,666,715 B2 * 12/2003 Fujita ..... H01R 27/02 439/540.1
7,258,493 B2 * 8/2007 Milette ..... B27N 3/007 385/55
7,651,277 B2 * 1/2010 Gurreri ..... B29D 11/0075 385/58
7,674,046 B2 * 3/2010 Milette ..... G02B 6/3831 385/53
2004/0242087 A1 12/2004 Hoshina

FOREIGN PATENT DOCUMENTS

EP 1527764 5/2005
WO 2011015915 2/2011

OTHER PUBLICATIONS

European Search Report, in corresponding Application No. 16189629.5, 9 pages.

* cited by examiner

*Primary Examiner* — Tulsidas C Patel
*Assistant Examiner* — Peter G Leigh
(74) *Attorney, Agent, or Firm* — Locke Lord LLP

(57) ABSTRACT

A power connector assembly includes a connector housing and a plurality of receptacles defined in the connector housing. Each of the receptacles defines a keyed interface profile such that each interface profile is adapted to individually couple to a respective feeder connector. Each one of the receptacles has an interface profile different from the other interface profiles.

The plurality of receptacles can include a first profiled interface, a second profiled interface and a third profiled interface. Each of the first, second and third profiled interfaces can define a longitudinal connector axis. The number of profile interfaces can be increased by selection of other angle positioned within the housing which prevent incorrect receptacles from be installed (i.e. connected).

12 Claims, 1 Drawing Sheet

POWER CONNECTOR ASSEMBLIES

BACKGROUND OF THE INVENTION

1. Field of the Invention

The present disclosure relates to connectors, and more particularly to electrical power connectors.

2. Description of Related Art

An electrical connector is an electro-mechanical device for joining electrical circuits as an interface using a mechanical assembly. Typical connectors consist of plugs (male-ended) and jacks (female ended). Electrical connectors are characterized by their physical construction, size, contact resistance, insulation between pins, ruggedness and resistance to vibration, resistance to entry of water or other contaminants, resistance to pressure, reliability, and ease of connecting and disconnecting. They may have locking mechanisms to ensure that they are fully inserted and cannot work loose or fall out. It is usually desirable for a connector to be easy to identify visually, rapid to assemble, require only simple tooling, and be inexpensive.

Such conventional methods and systems have generally been considered satisfactory for their intended purpose. However, there is still a need in the art for improved power connector assemblies. The present disclosure provides a solution for this need.

SUMMARY OF THE INVENTION

A power connector assembly includes a connector housing and a plurality of receptacles defined in the connector housing. Each of the receptacles defines a keyed interface profile such that each interface profile is adapted to individually couple to a respective feeder connector. Each one of the receptacles has an interface profile different from the other interface profiles.

The plurality of receptacles can include a first profiled interface, a second profiled interface and a third profiled interface. Each of the first, second and third profiled interfaces can define a longitudinal connector axis. The first profiled interface can be round. The second profiled interface can have a flat surface defined at a position parallel to the respective longitudinal connector axis. The third shaped body can have a flat surface defined at a position orthogonal to the respective longitudinal connector axis.

Each of the plurality of receptacles can have an internal thread and counter bore, e.g., defined respective to the longitudinal connector axis. A barrier frame can separate each receptacle from an adjacent receptacle. The shape of a respective barrier frame can match the interface profile of the respective receptacle. A plurality of feeder connectors can be aligned, each with a respective receptacle, wherein each of the feeder connectors has a profile which matches a respective interface profile.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
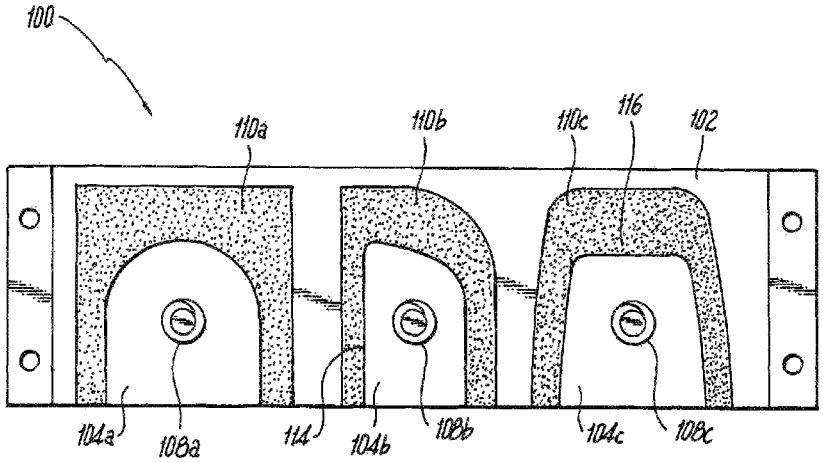
FIG. 1 is a top plan view of an exemplary embodiment of a power connector constructed in accordance with the present disclosure, showing three receptacles each having a different interface profile.

Reference will now be made to the drawings wherein like reference numerals identify similar structural features or aspects of the subject disclosure. For purposes of explanation and illustration, and not limitation, a partial view of an exemplary embodiment of power connector assemblies in accordance with the disclosure is shown in FIG. 1 and is designated generally by reference character 100. Other embodiments of the assemblies in accordance with the disclosure, or aspects thereof, are provided in FIG. 2, as will be described. The embodiments of the power connector assemblies 100 and aspects thereof provide for accurate connection within electrical systems between a power source and a device in less visible, tight space environments, e.g., a vehicle or aircraft. This reduces connection errors and the potential for damage to components of the electrical system.

With reference to FIG. 1 a power connector assembly 100 in accordance with the present disclosure is shown. The assembly 100 includes a connector housing 102 and a plurality of receptacles 104*a*, 104*b*, 104*c* defined in the connector housing 102. The receptacles 104*a*, 104*b*, 104*c* are designed to mate with corresponding matching contacts of feeder connectors 106*a*, 106*b*, 106*c*. Each of the receptacles 104*a*, 104*b*, 104*c* has a contact pin 108*a*, 108*b*, 108*c* which extends upwardly from the housing 102 with an internal thread and counter bore. Each of the contact pins 108*a*, 108*b*, 108*c* are a uniform, one size. The pin contacts 108*a*, 108*b*, 108*c* have one thread configuration so that voltage drop and mechanical strength between the connector and feeder contacts can be optimized. To prevent mismatch between the receptacles 104*a*, 104*b*, 104*c* and the feeder connector contacts 106*a*, 106*b*, 106*c*, each of the receptacles 104*a*, 104*b*, 104*c* defines an interface profile that has a profile different from the other interface profiles. In other words, each of the receptacles 104*a*, 104*b*, 104*c* has a unique interface with respect to the others such that a user connecting respective feeder contacts 106*a*, 106*b*, 106*c* will be prevented from a mis-connecting the three connections. Also shown in FIG. 1, a plurality of barrier frames 110*a*, 110*b*, 110*c* separates each receptacle 104*a*, 104*b*, 104*c*. Each barrier frame 110*a*, 110*b*, 110*c* defining a profile that matches the interface profile of the respective receptacle 104*a*, 104*b*, 104*c*, The barrier frame 110*a*, 110*b*, 110*c* provides further physical distinction between the receptacles 104*a*, 104*b*, 104*c* to facilitate preventing mismatch.

Figure 2:
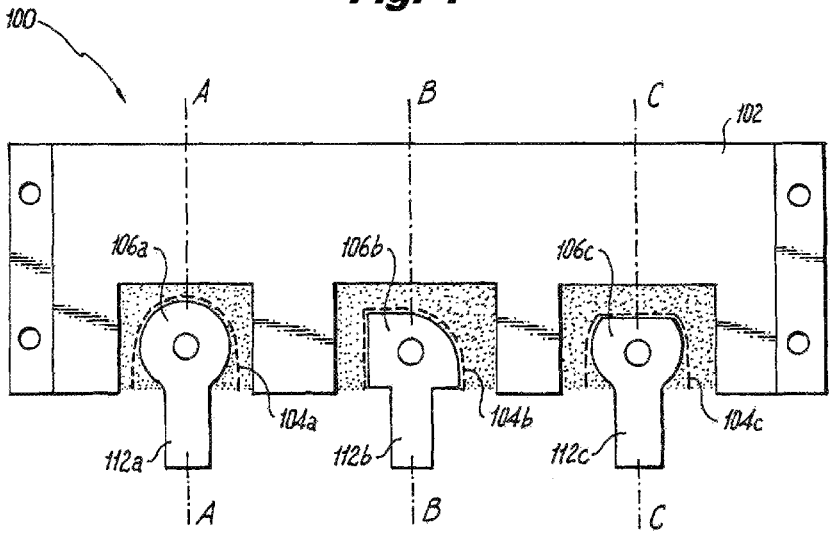
FIG. 2 is a top plan view of the power connector of FIG. 1, showing feeder connectors aligned with the three receptacles.

As shown in FIGS. 1 and 2, three receptacles 104*a*, 104*b*, 104*c* are shown. The barrier frames are not shown in FIG. 2 for ease of illustration. Each of the receptacles 104*a*, 104*b*, 104*c* defines a longitudinal connector axis, respectively A-A, B-B, C-C aligned with a respective feeder connector lead 112*a*, 112*b*, 112*c*. A first receptacle 104*a* has a round interface, a second receptacle 104*b* has a flat surface 114 defined at ninety degrees with the respective longitudinal connector axis B-B and a third receptacle 104*c* has a flat surface 116 defined at one hundred and eighty degrees with the respective longitudinal connector axis C-C. The flat surfaces 114, 116 act has keying flats to prevent mismatch. As the user connects a feeder contact 106*a*, 106*b*, 106*c* with a receptacle 104*a*, 104*b*, 104*c*, the user will be able to tell simply that the respective feeder contact 106*a*, 106*b*, 106*c* will or will not match the respective receptacle 104*a*, 104*b*, 104*c*. If a mismatch exists, the user is made aware that other mismatches may also exist. For example, if the user has three feeder contacts 106*a*, 106*b*, 106*c* that match the three receptacle 104*a*, 104*b*, 104*c* profiles of FIG. 1 and the user plugs in a feeder contact with a flat, e.g., 106*b* or 106*c*, in the first round receptacle 104*a* the connection will likely cause no issue. As the user moves to the next receptacle and attempts to now plug in a round feeder contact 106*a* into the second receptacle 104*b* profile with a flat 114, the user will be unable to make the connection because of the mismatch. As such, the user will know that the first receptacle 104*a* is also likely mismatched. The number of body shapes which can have a profile surface defined can be expanded to include notches, flats or radius surfaces which define specific geometry for interfaces. The number of profile interfaces can be increased by selection of other angle positioned within the housing which prevent incorrect receptacles from be installed (i.e. connected). During manufacturing the pin contacts 108*a*, 108*b*, 108*c* are all round profiled interfaces.

Prior to installation, the flat surfaces 114, 116 are machined. The remainder of the connector assembly 100, including the barrier frames 110*a*, 110*b*, 110*c*, are then modified by adding material to match each contacts keying flat surface. The connector housing 102 can be optimized for size and amperage rating based on the location and device. In addition, the connector housing can have additional features for protection, for example, a cover, and even a sealing assembly for harsh environments.

The methods and systems of the present disclosure, as described above and shown in the drawings, provide for a power connector assembly with superior properties including a plurality of receptacles each with a unique profile to prevent mismatch with a feeder connector contact. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A power connector assembly, comprising:

a connector housing; and a plurality of receptacles defined in the connector housing, each of the receptacles defining a keyed interface profile such that each interface profile is adapted to individually couple to a respective feeder connector, wherein each one of the receptacles has an interface profile different from the other interface profiles, and wherein each of the plurality of receptacles include a contact pin extending upwardly from the connector housing with an internal thread and a counter bore.

2. The assembly of claim 1, wherein the plurality of receptacles includes a first interface profile, a second interface profile and a third interface profile, each of the first, second and third interface profiles defining a longitudinal connector axis.

3. The assembly of claim 2, wherein the first interface profile is round.

4. The assembly of claim 2, wherein the second interface profile has a flat defined at a position ninety degrees from the respective longitudinal connector axis.

5. The assembly of claim 4, wherein the third interface profile has a flat defined at a position one hundred and eighty degrees from the respective longitudinal connector axis.

6. The assembly of claim 1, wherein at least one of the plurality of receptacles is round.

7. The assembly of claim 1, wherein at least one of the plurality of receptacles has a flat surface.

8. The assembly of claim 1, wherein at least two of the plurality of receptacles has a flat surface.

9. The assembly of claim 1, wherein a barrier frame separates each receptacle from an adjacent receptacle.

10. The assembly of claim 9, wherein the shape of a respective barrier frame matches the interface profile of the respective receptacle.

11. The assembly of claim 1, further comprising a plurality of feeder connectors aligned with a respective receptacle, wherein each of the feeder connectors has a profile which matches the respective interface profile.

12. The assembly of claim 1, wherein the internal thread of each contact pin is configured to optimize voltage drop and mechanical strength between the contact pin and the respective feeder connector.

* * * * *